United States Patent [19]

Sjöberg

[11] Patent Number: 4,723,660

[45] Date of Patent: Feb. 9, 1988

[54] APPARATUS FOR ADVANCING AND SORTING OBJECTS

[76] Inventor: Sven E. Sjöberg, 1 Fridländers Väg, S-561 39 Huskvarna, Sweden

[21] Appl. No.: 941,826

[22] Filed: Dec. 15, 1986

[30] Foreign Application Priority Data

Jan. 3, 1986 [SE] Sweden ..... 8600023

[51] Int. Cl.[4] ..... B07C 5/07; B07B 1/10

[52] U.S. Cl. ..... 209/622; 209/670

[58] Field of Search ..... 209/620, 621, 622, 659, 209/670, 665

[56] References Cited

U.S. PATENT DOCUMENTS

| | | | |
|---|---|---|---|
| 475,497 | 5/1892 | Fleming | 209/622 |
| 1,379,207 | 5/1921 | O'Quinn | 209/622 |
| 1,448,689 | 3/1923 | Hatch | 209/622 |
| 3,019,898 | 2/1962 | Bertinot | 209/622 |

FOREIGN PATENT DOCUMENTS

| | | | |
|---|---|---|---|
| 6500732 | 7/1965 | Netherlands | 209/622 |

*Primary Examiner*—David A. Scherbel
*Assistant Examiner*—Thomas W. Kearns
*Attorney, Agent, or Firm*—Cohen, Pontani & Lieberman

[57] ABSTRACT

An apparatus for advancing and sorting objects in respect of their size comprises a plurality of juxtaposed, endless conveyor belts (10) and gaps (9) between adjacent conveyor belts, each conveyor belt consisting of a plurality of hinged segments or chain elements (11) and a system (23, 24) for driving the conveyor belts. To obtain an advancement of the objects which is as lenient and noiseless as possible, the conveyor belts (10) are combined with and guided by guide rails (30) which extend substantially along the entire run of the belt which advances the objects. The guide rails are so arranged and designed, that the gap (9) between mutually adjacent conveyor belts continually increases along at least the major part of said belt run. Each belt segment (11) comprises a bridge portion which as seen in a cross section forms an inverted V and the ends of which are moveable with respect to each other in a direction which is substantially perpendicular to the advancement direction of the belt and are each connected to an individual base portion (13) which embraces and is guided by the two longitudinal edges of the guide rail (30).

13 Claims, 20 Drawing Figures

FIG. 1
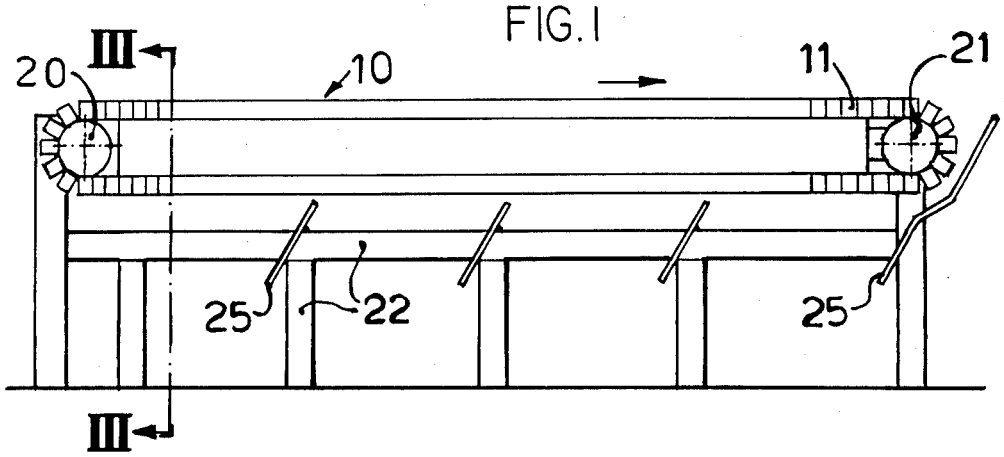
FIG. 2
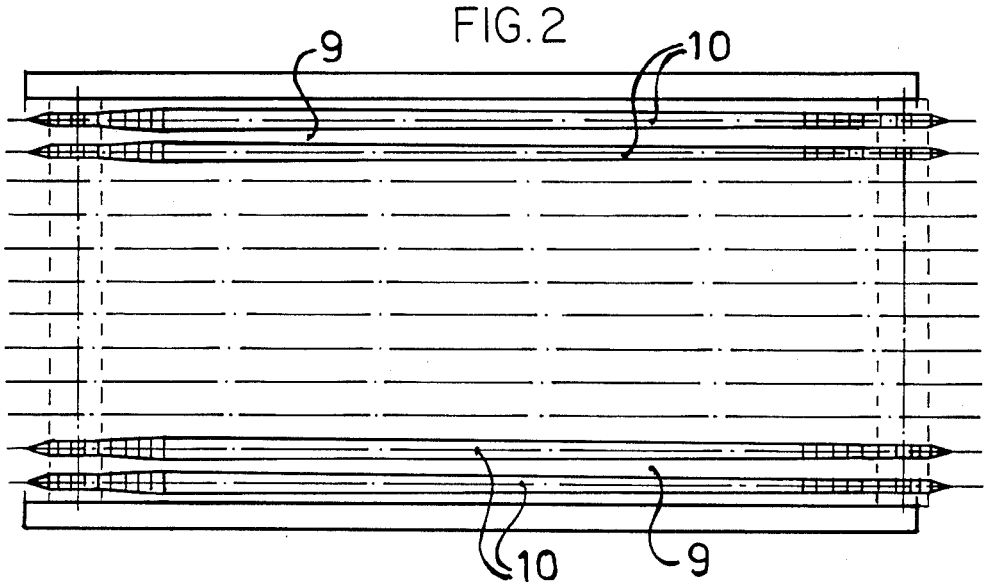
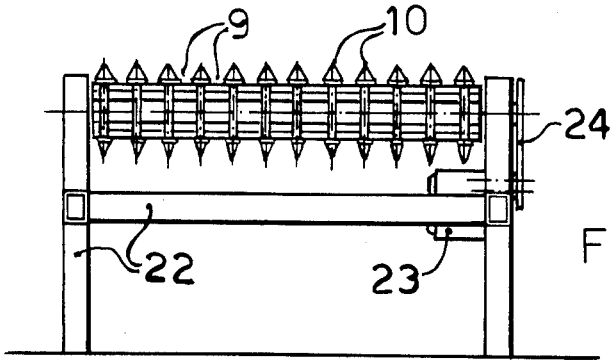
FIG. 3

FIG. 4
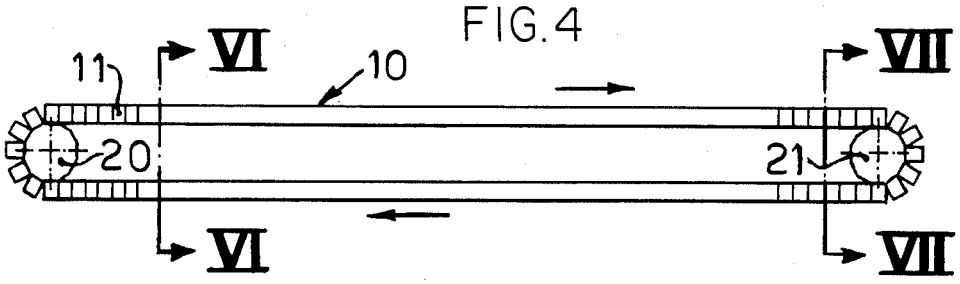
FIG. 5
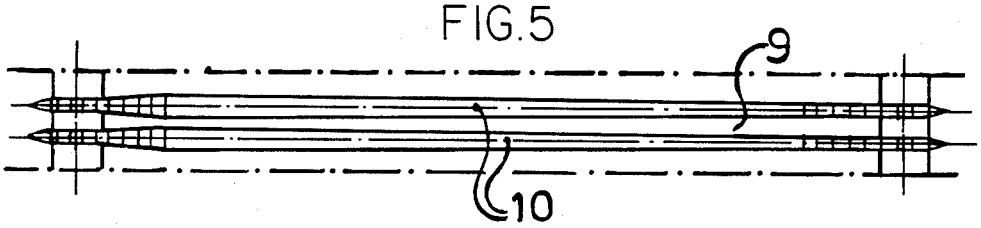
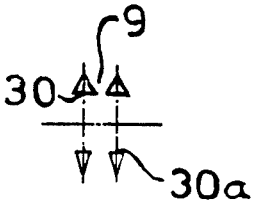
FIG. 6
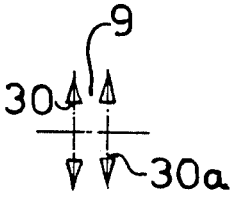
FIG. 7
FIG. 10
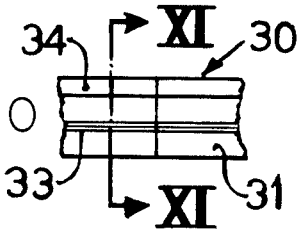
FIG. 11
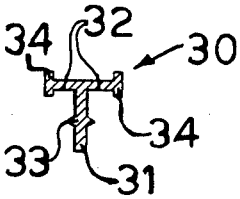
FIG. 8
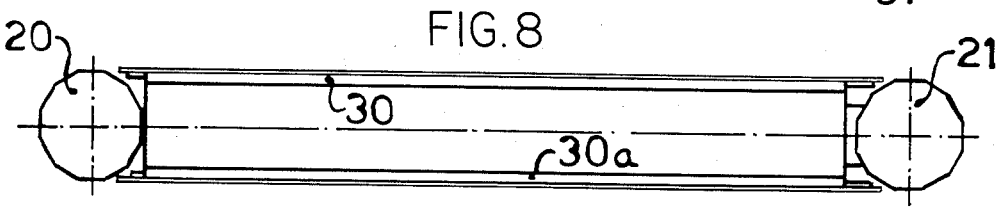
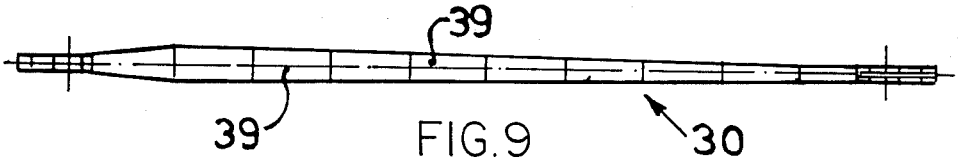
FIG. 9

APPARATUS FOR ADVANCING AND SORTING OBJECTS

BACKGROUND OF THE INVENTION

This invention relates to an apparatus for advancing and sorting objects with respect to their size as described in the preamble of claim 1. The apparatus according to the invention is primarily intended for sorting or sizing of fish but can, of course, be utilized also for sorting of other objects, e.g. peas, carrots and other vegetables.

Fish sorting machines now in use which are either located on board trawlers and other fishing boats or are erected on shore usually operate according to the vibration principle, a sloping table comprising a number of juxtaposed lathes, extending in the direction of slope and whose width diminishes continuously, and slits or slots which are located between the lathes and have a width which increases in the same extend as the width of the lathes decreases, being vibrated by means of an eccentric or the like. The fishes (or corresponding objects) falls down through the gaps, smaller fishes falling down before larger ones.

These known machines suffer from a plurality of drawbacks. Thus, the machines are very noisy on account of the inclusion of eccentrics or similar means for vibrating the lathes. Furthermore, there is a risk for fishes to get stuck and become jammed in the gaps between the lathes, hereby preventing other fishes from passing.

SUMMARY OF THE INVENTION

The principal object of the invention is to eliminate the above drawbacks and to provide a lighter and less bulky sorting machine which operates faster and with less noise and with greater leniency to the objects to be sorted than sorting machines of the prior art.

This object is attained thanks to the fact that the apparatus according to the invention is so constructed as is set forth in the characterizing clause of claim 1.

BRIEF DESCRIPTION OF THE DRAWINGS

Further features and advantages of the apparatus according to the invention will become apparent from the following description and the annexed drawings which diagrammatically and as non-limiting examples illustrate some embodiments of the invention.

FIG. 1 is a simplified side view of a sorting machine according to the invention which is primarily intended for fish.

FIG. 2 is a simplified plan view of the machine according to FIG. 1.

FIG. 3 is a diagrammatical cross sectional view on line III—III in FIG. 1.

FIG. 4 is a side view on a larger scale of a conveyor belt or chain.

FIG. 5 is a plan view of two adjacent conveyor chains according to FIG. 4 and on the same scale as this.

FIGS. 6 and 7 are simplified cross sectional views of the conveyor chain according to FIG. 4 on lines VI—VI and VII—VII, respectively, in FIG. 4.

FIG. 8 is a diagrammatical side view of a drive wheel and an appurtenant idle wheel and a pair of guide rails which extend between these wheels for guiding the upper run and the lower run, respectively, of the conveyor chain.

FIG. 9 is a plan view of a guide rail according to a first embodiment of the invention.

FIG. 10 is a partial side view of part of the guide rail according to FIG. 9 on a larger scale.

FIG. 11 is a cross sectional view on line XI—XI in FIG. 10.

Figure 12:
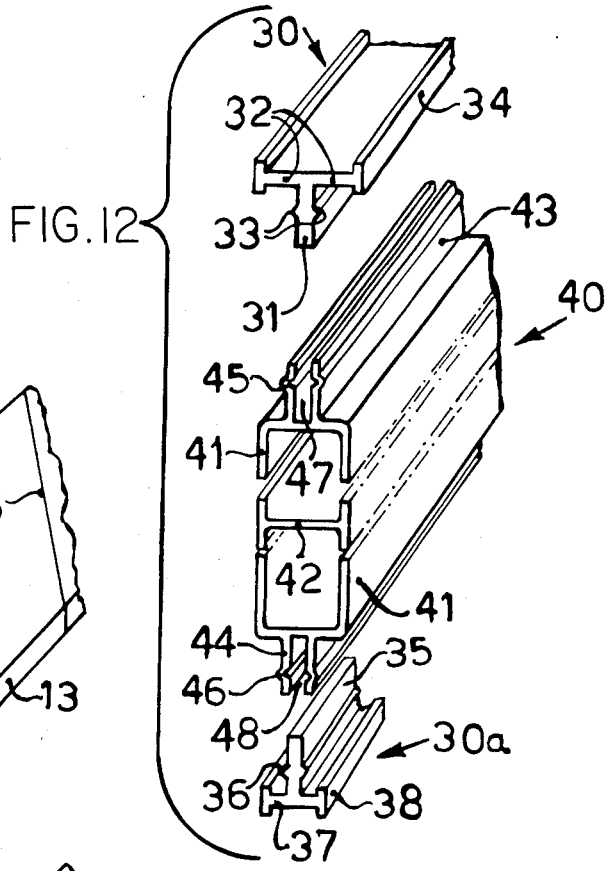
FIG. 12 is an exploded perspective view of the two guide rails according to FIGS. 8–11 and of a preferably extruded section of plastic or the like interconnecting said guide rails.

In all Figures the same or similar references are utilized to designate same or corresponding details.

DESCRIPTION OF THE PREFERRED EMBODIMENT

The machine according to FIGS. 1–9 comprises a plurality, e.g. 15–20, of endless conveyor belts which are generally designated 10 and of which only few are shown in FIGS. 2 and 5. The belts are each driven by an individual reversing or idle wheel 21, which is biased by a spring or the like in a direction away from their respective driving wheels to maintain the belts 10 extended. The belts 10 are driven in synchronism with each other in the direction indicated by arrows in FIG. 1 and 4 by means of an electric or hydraulic motor 23 (FIG. 3) through a suitable transmission 24. Between the belts 10 there are gaps or slots 9 (FIGS. 2 and 5). The parts mentioned above are supported by a framework 22 in which also a plurality of preferably adjustable guiding plates 25 for the sizing are secured.

Each belt 10 consists of a great number, e.g. 200–400, segments or chain elements 11 which are hingedly interconnected for forming an endless belt or chain. All chain elements 11 have the same constant length, and the chain wheels or sprockets 20, 21 preferably have a polygonal (instead of circular) contour with an edge length which corresponds to the length of the chain or belt elements 11.

With each belt 10 at least one guide rails cooperates which is generally designated 30 (**30*a*) and of which different embodiments are illustrated in FIGS. 10–12 and 15, 17, respectively. Preferably, there is provided an upper guide rail 30 for the upper stretch or run of the conveyor belts which carries and advances the fish (or generally the objects), and a corresponding guide rail 30*a* for the lower (return) stretch or run of the belts 10**.

When the guiding vanes or plates 25 are arranged below the lower stretch of the conveyor belts 10, as is illustrated in FIG. 1, the lower guide rails 30*a* are narrower than the upper ones 30 to permit the fishes or corresponding objects to pass unobstructed between them into the respective collecting container (not shown).

As is apparent from FIG. 8 the guide rails 30, 30*a* extend between and bridge the entire distance between the belt wheels or sprockets 20, 21. According to FIG. 12 the upper guide rail and the lower guide rail of each pair are mutually interconnected by means of an extruded injection moulded, hollow section 40 of plastic or the like. In FIG. 12 two longitudinal portions of the side walls 41 of the section on opposite sides of a central, longitudinal partition wall 42 which divides the cavity into two equal parts have been cut away to keep the height of the Figure low. From each of the two opposite end walls turned away from each other of the cavities a pair of longitudinal flanges 43 and 44, respectively, project, each of which has a longitudinal protuberance or groove, 45 and 46, respectively, and which together define a groove 47 and 48, respectively.

The upper guide rail 30 according to FIGS. 10 and 12 has a substantially T-shaped cross section with a T-ascender 31 and two arms or flanges 32 perpendicular thereto. The ascender 31 is adapted to cooperate with and be embraced by the two upper, longitudinal flanges 43 of the plastic section 40 and therefore have the same width as the slot or groove 47 therebetween as well as two mutually opposing, longitudinal ridges or the like 33, which are adapted to engage the grooves 45 of the flanges 43. Each T-arm 32 is in its turn substantially T-shaped in cross section, having upwardly and downwardly projecting, longitudinal edge flanges 34, the purpose of which will become apparent from the following.

The lower guide rail 30*a* is basically analogous to the upper one 30 but narrower than this and has similarly one T-ascender portion 35 with two opposing, longitudinal ridges 36 which are intended to engage the grooves 46 of the flanges 44 of the plastic section, and two T-arms 37 with projecting, longitudinal edge flanges 38 which correspond to the edge flanges 34 of the T-arms.

In accordance with an essential characteristic of the invention the upper guide rails 30 widens comparatively quickly in the direction from the driving wheel 20 and attains its maximum width in the vincinity thereof, as is most clearly apparent from FIG. 9. After that the rail 30 comparatively slowly becomes narrower in the direction towards the idle wheel or pulley 21. The gaps 9 widen in the same measure as the width of the rails 30 diminish. According to another feature of the invention the rail 30, as is also apparent from FIG. 8, is divided into sections or elements 39, each of which may be replaceable by narrower or wider elements to increase or decrease, respectively, the gap 9 between adjacent guide rails 30.

The rails 30, 30*a* are provided for guiding the conveyor belts 10, the chain or belt elements 11 of which are specially designed in accordance with a further characteristic feature of the invention. Each chain element 11, two embodiments of which are illustrated in FIGS. 13–14 and 16–17, respectively, comprises a bridge portion consisting of two sides 12 which are hingedly interconnected along their common upper edge 14 and form a V when seen in cross section and are according to FIG. 13 each rigidly connected to an individual base member 13 at the edge which opposes the common edge 14. The common joint 14 consequently operates as a hinge for the sides 12 and permits an increase and a decrease of the angle between the sides 12 as well as a corresponding increase or decrease, respectively, of the distance between the base member 13. In the embodiment according to FIG. 13 each base member 13 is made integral with the corresponding base member of adjacent chain elements 11, along the whole belt 10. Each of the base members 13 has a groove 15 having a substantially T-shaped cross section which as to shape and dimensions corresponds to the T-arms 32, 34 and 37, 38, respectively, of the rails 30 and 30*a*, with which grooves they are intended to cooperate. The sides 12 of adjacent chain elements are separated from each other by slits or the like 16.

Figure 13:
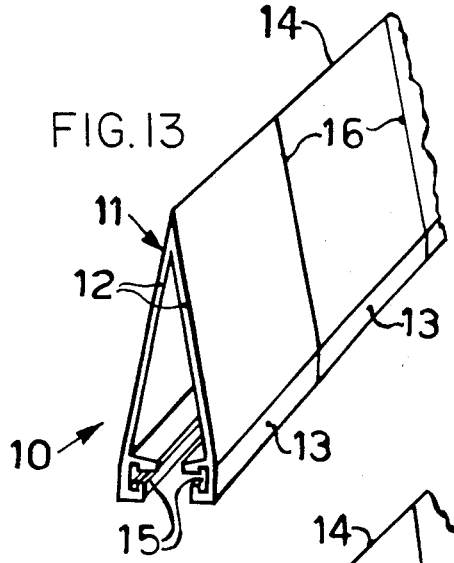
FIG. 13 is a perspective view of part of a conveyor chain which is designed for cooperation with the guide rails illustrated in FIGS. 9–12.
Figure 14:
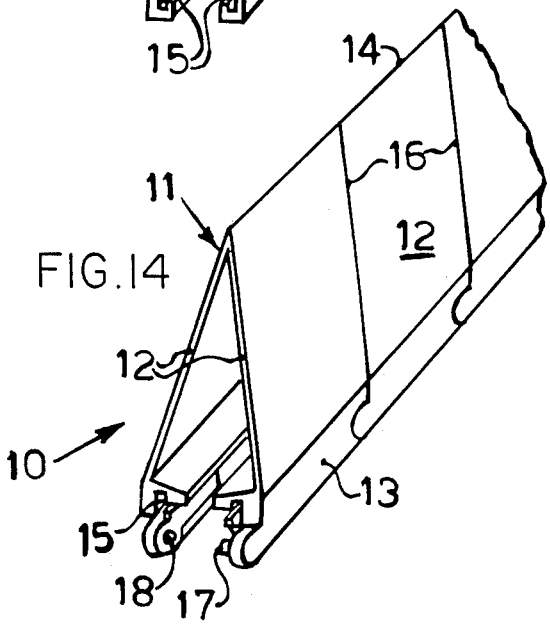
FIG. 14 is a corresponding, partial perspective view of a modified conveyor chain.

In the embodiment according to FIG. 14 the chain elements 11 of the belt 10 distinguishes from those shown in FIG. 13 only in that the chain elements 11 according to FIG. 14 constitute separate or individual parts. According to FIG. 14 each base member 13 is at one of its ends provided with a pivot or hinge pin 17 and at its other end with a corresponding pin aperture 18. The pins 17 of the chain elements are like the pin apertures 18 located mutually diagonally, which means that the chain elements 11 become turnable on a central symmetry line which is perpendicular to the common edge 14. The pins 17 and the pin apertures 18 constitute means for hinged interconnection of mutually adjacent chain elements 11 for forming a continuous conveyor belt 10.

When the belts 10 according to FIGS. 9–14 are driven or advanced by means of the motor 23 and the transmission 24, they carry with themselves the objects (not shown) which are deposited on the belts 10 at the end represented by the driving wheels 20 and advanced in the direction towards the idle wheels 21. On account of the sliding engagement between the T-arms 32, 34 of the rails 30 and the grooves 15 of the base members 13 the base members 13 of the chain elements compulsorily follow the edges of the rails 30. This means that the gaps 9 (FIG. 2, 5 and 7) between adjacent belts become wider in the direction towards the idle wheels 21 in dependence of the diminishing widths of the rails 30. When advanced by the belts fishes or other objects having small cross dimensions thus fall down through the gaps 9 before larger objects. This makes possible a sizing segregation of the object in different size classes through cooperation with the guide plates 25.

Figure 15:
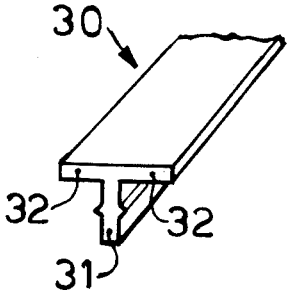
FIG. 15 is a partial perspective view of a guide rail according to a modified embodiment.
Figure 17:
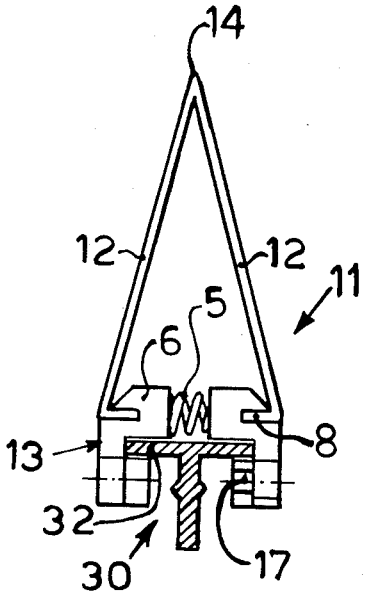
FIG. 17 is a cross sectional view of the guide rail and the appurtenant chain element according to FIGS. 15–16.

The guide rail 30 according to FIGS. 15 and 17 is a simplified version of the rail 30 illustrated in FIG. 12 and distinguishes therefrom principally in that the arms 32 have no longitudinal T-flanges 34.

Figure 16:
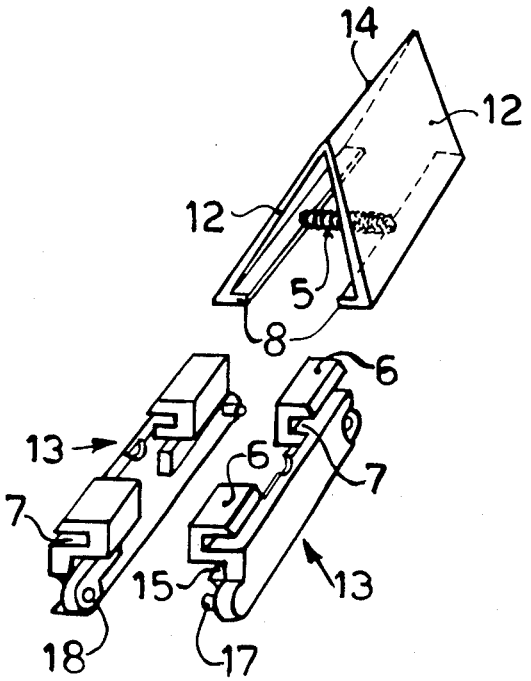
FIG. 16 is an exploded perspective view of a chain element which is comprised in a conveyor chain designed for cooperation with the guide rail according to FIG. 15.

With the rail 30 according to FIG. 15 chain elements 11 according to the composite perspective view of FIG. 16 are intended to cooperate. This element is basically analogous with those illustrated in FIGS. 13–14 and distinguishes therefrom principally therein that the two base members 13 constitute separate or individual links which are detachably joinable with the bridge elements 12, 12 and suitably are manufactured of injection moulded plastic. Those edges of the bridge sides 12 which are located opposite the common edge 14 are angularly bent towards each other to form flanges 8. These are intended to engage grooves 7 defined by link projections 6 having a substantially U-shaped cross section. Springs 5 maintain, on one hand, the flanges 8 in engagement with the grooves 7, and on the other hand the grooves 15 in engagement with the T-arm flanges 32 of the guide rail 30.

The guide rail 30 and the chain elements 11 according to FIGS. 15–17 operate basically in the same way as corresponding elements of the embodiment according to FIGS. 10–14.

Figure 18:
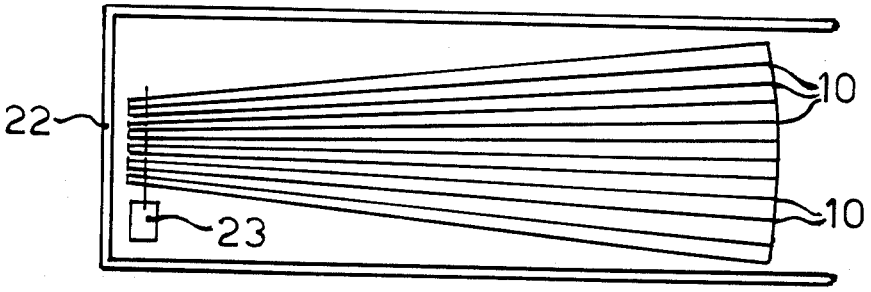
FIG. 18 is a plan view, corresponding to FIG. 2, of a modified advancing and sorting apparatus according to the invention.

In FIG. 18 which is a very simplified plan view of the segregating or sorting apparatus according to the invention, is shown how the gap or distance between adjacent conveyor belts 10 is continuously increased from the feed end of the objects to be sorted in direction towards their outlet end by making the conveyor belts 10 and their guide rails (not shown) fan out in said direction. This spreading out of the outlet ends of the conveyor belts 10 may possibly be supplemented with a decrease of the effective widths of the belts according to the embodiment described above.

Figure 19:
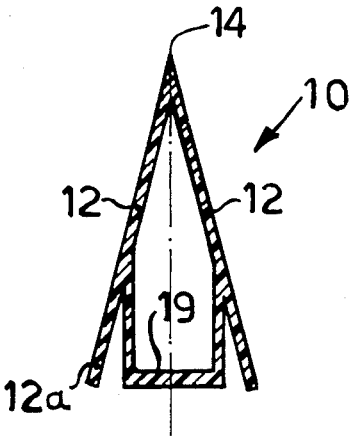
FIG. 19 is a cross sectional view of a modified conveyor belt or chain.

According to FIG. 19 the conveyor belts 10 which as in the embodiments described above consist of segments or the like which are mutually joined by means of hinges, have a substantially V-shaped cross section and comprise two side walls 12. These are mutually united by means of a U-section 19 extending along the whole extension of the conveyor belts. The lower, free edge portions 12*a* of the conveyor belts, which in FIG. 19 are located below those lines along which the U-section 19 is united with the walls 12, constitute flexible flaps in each segment.

Figure 20:
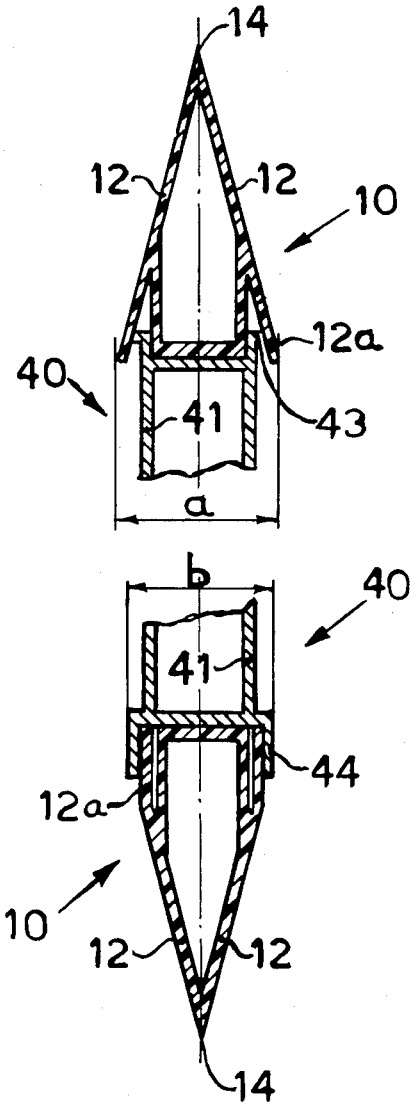
FIG. 20 is a cross sectional view of the two runs or stretches of the conveyor belt according to FIG. 19 and of an interposed guide rail for the belt.

The guide rail 40 in each FIG. 20 is, like its counterpart in FIG. 12, substantially comprised of a hollow section which has two side walls 41 and from which two pairs of longitudinal flanges 43, 44 project at the upper and lower ends, respectively. The two pairs of flanges are substantially L-shaped in cross section. The flanges 43 which cooperate with the upper run of the conveyor belts 10 deflect the marginal flaps 12*a* of the side walls 12 of each belt segment outwards, so that the distance a between the lower edges of the flaps 12*a* becomes comparatively large. The flanges 44 which cooperate with the lower run of the conveyor belts 10 deflect the marginal flaps 12*a* of the side walls 12 of each belt segment inwardly, so that the distance b between the lower edges of the flaps 12*a* (including the width of the flanges 44) becomes less than a to permit the sorted objects to pass the lower run of the conveyor belt 10 without obstruction to their respective sorting compartment.

The embodiments described above and illustrated in the drawings are, of course, to be regarded merely as non-limiting examples and may as to their details be modified in several ways within the scope of the following claims. For example, new embodiments which are also comprised by the inventive idea may be created by combining details, which are taken from different ones of the exemplificatory embodiments described above, in suitable ways. Furthermore, at least when the sorting of certain, smaller objects is concerned, the guiding plates 23 may be placed between the upper and lower runs of the belts 10, which means that the gaps 9 (FIGS. 6 and 7) between the lower runs of adjacent conveyor belts not necessarily have to be wider than the gaps 9 between the upper runs. In addition hereto the lower guide rail 30*a* may be omitted, at least in some cases.

What I claim is:

1. Apparatus for advancing and sorting objects with respect to their size, comprising a plurality of juxtaposed, endless conveyor belts (10) running over individual driving wheels and idle wheels, and means (23, 24) for driving the conveyor belts, substantially in synchronism with each other, each conveyor belt (10) comprising a plurality of chain or belt elements or segments (11) which are hingedly interconnected, each segment having a pair of mutually interconnected base members (13) which during their travel are guided by and in slide contact with a common guide rail (30), which is comprised in a set of juxtaposed guide rails, as well as a bridge portion (12, 12) cooperating with the objects and interconnecting the base members of the respective pairs and having two sides (12) which are turned away from each other and are united with each other along a common edge or line (14) which is parallel to the direction of advancement and is located at that end of each chain element which is remote from the base members (13) of the respective chain elements (11), characterized in that those ends of the two sides (12) of each chain element which are located nearest to the respective base members (13) are movable with respect to each other in a direction which is perpendicular to the direction of advancement, and in that the guide rails (30) have two grooves, edges or similar guide means (32, 34; 37, 38; 43, 44. FIG. 20) provided for cooperation with the chain elements and extending along the guide rails, the mutual distance between said guide means being larger in the vicinity of that end of the apparatus at which the objects to be sorted are introduced into the apparatus than it is at the opposite end thereof, said guide means being arranged for deflecting the sides (12) of the respective bridge portions from each other in such a manner, that the gap (9) between the advancing run of each of any two adjacent conveyor belts (10) is smaller at that end of said belt runs at which the objects to be sorted are introduced into the apparatus than it is in the vincinity of the other end of said belt runs.

2. Apparatus according to claim 1, characterized in that said sides (12) of the bridge portion of each chain element (11) are substantially rectangular and are hingedly or resiliently united with each other along said edge or line (14) in that said bridge portion as seen in cross section substantially forms an inverted V when the chain element constitutes part of the advancing conveyor belt run, and in that each one of the two bridge sides (12) of the chain elements (11) is connected to an appurtenant base member (13) along an edge opposing said edge or line (14).

3. Apparatus according to claim 1, characterized in that said sides (12) of the bridge portion of each chain element (11) are substantially rectangular and together substantially form an inverted V when the chain element is comprised in the advancing run of the conveyor belt, and in that only those portions (121) of the sides of the respective bridge portions which are located farthest from said common edge or line (14) and nearest to the base members (13) of the chain elements are movable towards and away from each other in directions which are perpendicular to the direction of advancement.

4. Apparatus according to claim 1, characterized in that each chain element (11) is made in one piece.

5. Apparatus according to claim 1, characterized in that the two bridge sides (12) of each chain element are made in one integral piece and are each removably connected to an individual appurtenant base member (13).

6. Apparatus according to claim 5, characterized in that the two bridge sides (12) of each chain element are mutually interconnected by means of a tension spring (5) or a similar elastic member which biases the sides towards each other, and at their said opposing edges have engagement means adapted to cooperate with and engage corresponding engagement means (6, 7) of an individual base member (13) comprised in the chain element.

7. Apparatus according to claim 1, characterized in that the respective base members (13) of mutually adjacent chain elements (11) are jointlessly united with each other, each bridge side (12) of a chain element being separated from the corresponding side of adjacent chain elements by a slot or slit (16).

8. Apparatus according to claim 5, characterized in that the base members (13) of each chain element are made in the form of a pair of links (13) or the like which have a hinge pin (17) at one of its ends and an aperture (18) for such a hinge pin at its opposite end, the hinge pin of each link being adapted to engage an aperture (18) which is comprised in the base member of an adjacent chain element.

9. Apparatus according to claim 1, characterized in that the base members (13) of the chain elements as well as the guide rails (30) have mutually cooperating means for compulsory guidance of the base members (13) of the chain elements in dependence of the widths of the guide rails (30).

10. The apparatus according to claim 6, wherein the engagement means is formed by mutually opposing flanges (8).

11. The apparatus according to claim 9, wherein the cooperating means is formed by grooves (15) having a substantially T-shaped cross-section and whose T-ascenders face each other, and corresponding flanges (32) having a substantially T-shaped cross-section and being arranged to engage and slide in the T-grooves.

12. The apparatus according to claim 2, characterized in that the two bridge sides (12) of each chain element are made in one integral piece and are each removably connected to an individual appurtenant base member (13).

13. The apparatus according to claim 6, characterized in that the base members (13) of each chain element are made in the form of a pair of links (13) or the like which have a hinge pin (17) at one of its ends and an aperture (18) for such a hinge pin at its opposite end, the hinge pin of each link being adapted to engage an aperture (18) which is comprised in the base member of an adjacent chain element.

* * * * *